United States Patent [19]

Movick

[11] 3,951,204

[45] Apr. 20, 1976

[54] METHOD AND APPARATUS FOR THERMALLY CIRCULATING A LIQUID

[76] Inventor: Nyle O. Movick, 4600 Macky Way, Boulder, Colo. 80303

[22] Filed: July 22, 1974

[21] Appl. No.: 490,437

[52] U.S. Cl. ..... 165/1; 165/106; 237/60

[51] Int. Cl.[2] ..... F28D 15/00

[58] Field of Search ..... 165/105, 106, 1; 237/60, 64; 126/271

[56] References Cited

UNITED STATES PATENTS

| | | | |
|---|---|---|---|
| 1,658,412 | 2/1928 | Parker | 237/60 |
| 2,707,593 | 5/1955 | Woodcock | 237/60 |

FOREIGN PATENTS OR APPLICATIONS

| | | | |
|---|---|---|---|
| 105,249 | 8/1899 | Germany | 237/60 |

*Primary Examiner*—Albert W. Davis, Jr.
*Attorney, Agent, or Firm*—Thomas W. O'Rourke

[57] ABSTRACT

Method and apparatus for transferring heat from an elevated location to a lower location through a thermally circulated working liquid substantially without height limitation, in which heat is provided at the higher location to the liquid in a first stand pipe, the liquid is ejected as a result of such heat from the top of the first stand pipe into a collector communicating with a second stand pipe, the first and second stand pipes being connected at the bottom portions, thereby unbalancing the liquid levels in the two stand pipes, means for providing thermal equilibrium between the liquid in the stand pipes through the lengths thereof below the point at which the heat is added, and means for extracting heat from the liquid at the lower location.

6 Claims, 3 Drawing Figures

METHOD AND APPARATUS FOR THERMALLY CIRCULATING A LIQUID

BACKGROUND OF THE INVENTION

1. Field of the Invention

The present invention relates generally to methods and apparatus for thermally circulating a liquid, and more particularly to method and apparatus for thermally cycling a liquid in a direction counter to that of a normal thermal syphon without substantial limitation as to height.

2. Description of the Prior Art

In a substantially closed-loop liquid system, it is, of course, known that thermal syphon effect will transfer heat from a lower position to a more elevated position. By applying heat at a lower position, the liquid expands thereby lowering its density whereupon the heated liquid is displaced upward by more dense liquid at a lower temperature. This connection displacement induces a circulation whereby the heated liquid rises to the top of the system while the cooled liquid flows to the bottom. By extracting heat at an elevated location in the system, heat pumping by means of the thermal syphon is accomplished.

Obviously, the limitation of extracting heat at an elevated location while applying it at a lower location has limitations for many uses. For instance, solar heating is generally accomplished by collecting heat from solar radiation at an elevated position, such as a roof, and supplying it at a lower location, such as a basement heat sink.

Partial solutions to the problem of delivering heat from an elevated to a relatively lower position have been previously proposed. For instance, U.S. Letters Pat. Nos. 2,170,225 and 2,707,593 disclose means by which heat induced circulation contra to that of a thermal syphon is accomplished. However, these concepts are limited as to the height over which such circulation may be accomplished. For instance, in U.S. Letters Pat. No. 2,170,225, heat is applied to one vessel thereby displacing a liquid through a stand pipe into a higher vessel. The higher vessel and the stand pipe are connected by a closed loop of vessels and piping. Accordingly, the difference in level induces a flow of relatively heated liquid through the closed loop. Heat may be extracted at a lower portion of the closed loop and the liquid then returned to the first vessel. However, as a result of the heat extraction, the density of the liquid in different legs, i.e., the supply leg and the return leg, tends to offset the liquid level differential. When the height of the two legs is of a substantial magnitude, flow terminates even though there is a difference in liquid level between the stand pipes and second vessel. Accordingly, the prior art systems are height limited.

SUMMARY OF THE INVENTION

The present invention, which provides a heretofore unavailable improvement over previous thermal circulation apparatus and methods, comprises a method and apparatus for initially providing an unbalance between two connected stand pipe systems to provide a flow, but which balances the densities of the liquid in the stand pipe systems below the upper portion at which heat is applied to provide a method and apparatus which is not height limited.

Accordingly, an object of the present invention is to provide a new and improved method and apparatus for thermally circulating heat from an elevated location to a lower location.

Another object of the present invention is to provide a new and improved method and apparatus for thermal circulation in a direction opposite that of conventional thermal syphon circulation.

Yet another object of the present invention is to provide a new and improved method and apparatus for thermally circulating and pumping heat from an elevated location to a lower location which is not height limited.

Still another object of the present invention is to provide a new and improved method and apparatus for providing heat from an elevated location to a lower location which will not reverse the heat flow if the temperature relationship of the location is reversed.

These and other objects and features of the present invention will become apparent from the following description.

DETAILED DESCRIPTION OF THE INVENTION

Figure 1:
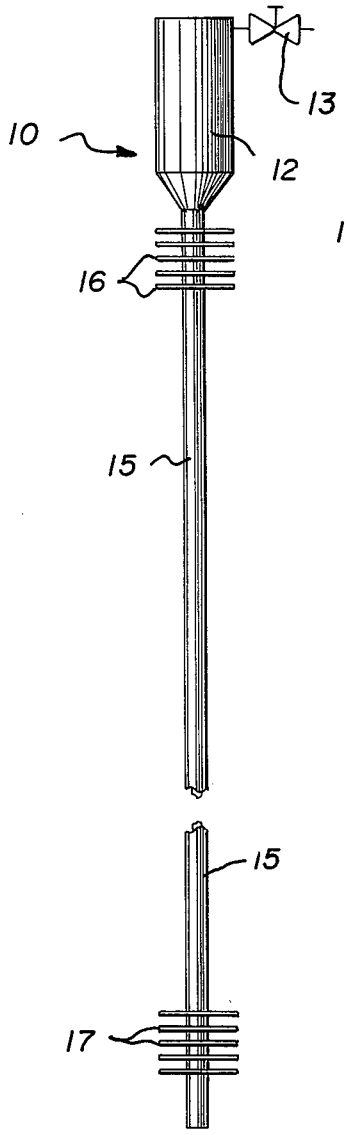
FIG. 1 is a simplified view of an apparatus according to the instant invention.

Turning now to the drawings, whererin like components are designated by like reference numerals throughout the various figures, an apparatus for thermally pumping heat from an elevated to a lower position is illustrated in FIG. 1 and generally designated by numeral 10. Externally, apparatus 10 includes an enlarged expansion chamber 12 at the upper portion thereof, having a filling and pressure regulating valve 13 preferably located at the upper portion of expansion chamber 12 and communicating with the interior thereof. Located immediately adjacent expansion chamber 12 and in communication with an external stand pipe 15 is heat input means shown as fins 16. Fins 16 are adapted to supply heat from a source (not shown) to external stand pipe 15. At the bottom portion of external stand pipe 15 there is provided a means for extracting heat shown as heat extraction fins 17.

Figure 2:
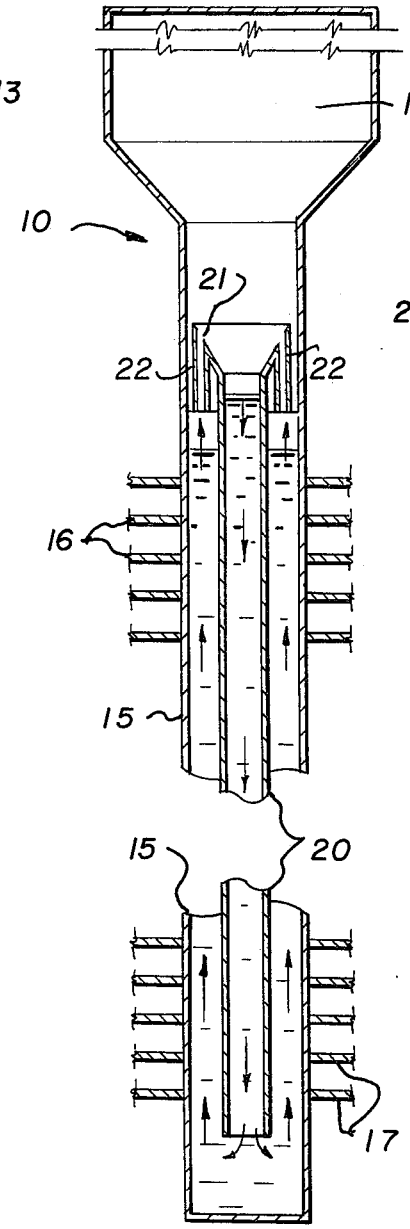
FIG. 2 is a sectioned, more detailed view of the apparatus of FIG. 1.

Specific operation of apparatus 10 will be readily understood with reference to FIG. 2 which illustrates the operational details of apparatus 10. An internal stand pipe 20 having an internal collector 21 with inlet pipe 22 disposed at the upper portion thereof, and at the lower portion of expansion chamber 12 are included. It will be noted that internal stand pipe 20 and external stand pipe 15 are in communication with one another at a location below heat extraction fins 17. Also, it will be noted that external stand pipe 15 and internal stand pipe 20 are filled with liquid to a level intermediate heat input fins 16 and internal collector 21. Accordingly, when heat is provided through heat input fins 16, the liquid in external stand pipe 15 is heated to a boiling condition thereby expelling liquid upward through inlet pipes 22 into expansion chamber 12 in a manner described in the above-mentioned prior art patents. Also, vapor is concurrently provided from external stand pipe 15 to expansion chamber 12. The liquid expelled from external stand pipe 15, through inlet pipes 22 and the vapor condensed in expansion chamber 12 are intercepted by internal collector 21 and conducted into internal stand pipe 20. As a result, the relative liquid levels between the liquid in external stand pipe 15 and internal stand pipe 20 differ as shown in an exaggerated manner in FIG. 2 with the level in internal stand pipe 20 being higher. This, of course, induces a flow down internal stand pipe 20 and up external stand pipe 15.

Further, as a result of the heating and condensation, the liquid in internal stand pipe 20 tends to be a relatively elevated temperature with regard to the surroundings. As the heated liquid travels down internal stand pipe 20, it tends to come to a temperature equilibrium with the liquid traveling upward in external stand pipe 15. However, it is to be understood that the entire system is at a temperature sufficiently high to permit extraction of heat at heat extraction fins 17. At external surfaces elsewhere, apparatus 10 is preferably insulated.

While the liquid is either internal stand pipe 20 or external stand pipe 15 tends to be a relatively higher temperature in the vicinity of heat input fins 16, and while the liquid in external stand pipe 15 tends to be at a relatively lower temperature adjacent to and somewhat above heat extraction fins 17, for the most part, the liquid in internal stand pipe 20 and external stand pipe 15 tends to be at an intermediate and substantially equal temperature for the main portion of the concurrent length of these members. Accordingly, there is no substantial difference in density between the liquid in internal stand pipe 20 and external stand pipe 15. For this reason, heat can be pumped from the elevated location of heat input fins 16, to heat extraction fins 17 located a substantial distance lower. With only localized differences in temperatures, and with substantial equality of temperature over the greater portion of the length of internal stand pipe 20 and external stand pipe 15, little resistance to flow because of density differences exists.

The liquid utilized as the working fluid may be any boilable liquid such as water, alcohol, glycols, mixtures thereof, and like compounds such as freon, etc. While fins 16 and 17 are symbolically to indicate the position and general nature of the heat input and heat extraction, it will, of course, be understood that heat exchanger means of any nature including liquid to liquid and liquid to gas interfaces may be utilized.

Figure 3:
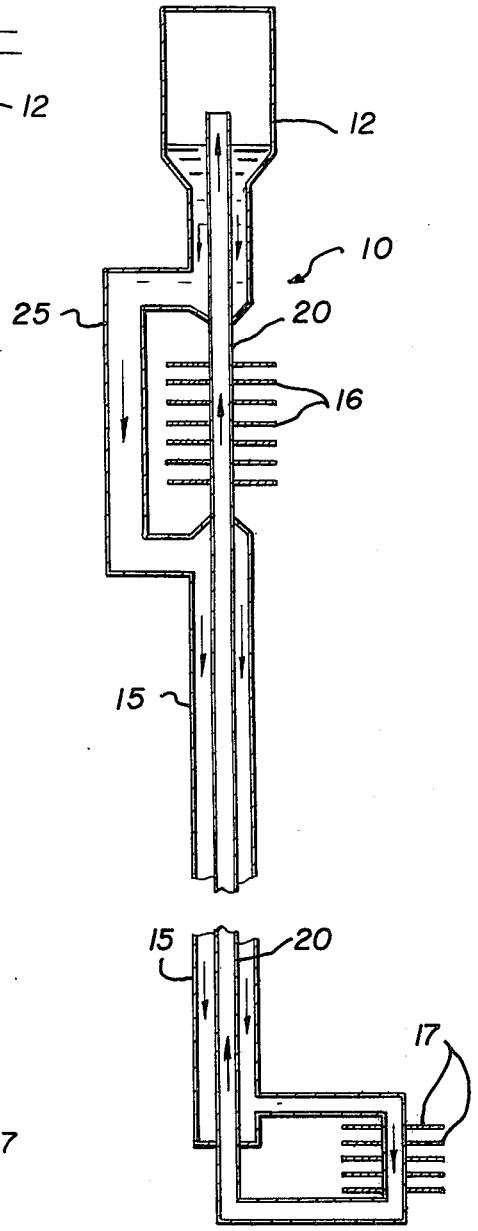
FIG. 3 is a simplified, sectioned view of another embodiment of the apparatus of the instant invention.

Another embodiment of the invention essentially similar in operation but with reverse flow from that of FIGS. 1 and 2 is illustrated in FIG. 3. In this instance, heat is applied to internal conduit 20 which extends into expansion chamber 12. Accordingly, since the heated liquid will move upward in internal stand pipe 20, the lower portion on expansion chamber 12 serves the collector function and no need for internal collector 21 as in FIGS. 1 and 2 exist. However, a bypass portion 25 is provided to permit application of the heat to internal stand pipe 20 through heat input fins 16. Other than the reverse direction of flow and the obviating of the need for internal collector 21 through the provision of bypass portion 25, the operation of the embodiment of FIG. 3 is essentially the same as that of the embodiments of FIGS. 1 and 2.

Summarily, the method and apparatus of the instant invention permits the input of heat to an elevated location in a system. The heat unbalances the liquid level between two stand pipes by displacing liquid from one stand pipe to the other stand pipe and, thus, induces a flow between the stand pipes. This enables the system to pump heat from an elevated to a lower position. Further, the stand pipes are in thermal contact with one another, and preferably concentric, to permit thermal equilibrium between the liquids in the two pipes. Thus, differentials in pressure as a result of densities of liquid are avoided. Even though the two stand pipes circulate liquid at an essentially common temperature over most of the length of the stand pipes, the liquid is at a temperature sufficiently elevated to permit extracting of heat at the lower location. Finally, since the liquid level does not reach to the communication between the stand pipes at the upper level, reversal of the temperature relationship between the upper location and lower location will not induce a reverse flow. This is useful, for instance, in the instance of solar heating to preclude reverse pumping of heat from a heat sink to a solar collector which functions as a radiation cooler at night.

Although only two related embodiments of the present invention have been illustrated and described, it is anaticipated that various changes and modifications will be apparent to those skilled in the art and that such changes may be made without departing from the scope of the invention as defined by the following claims.

What is claimed is:

1. Apparatus for transferring heat from an elevated location to a lower location, comprising: first and second stand pipes adapted to contain a fluid and extending from an elevated location to a lower location, the two stand pipes connected for flow therebetween at the lower ends thereof, means for supplying heat to one of the stand pipes at the elevated location, means for collecting liquid expelled from the stand pipe to which heat is added and conveying the collected fluid to the other stand pipe, and means for extracting heat from one of the stand pipes at the lower location, the stand pipes being in a mutual, thermal-conductive relationship at least over a substantial portion of the lengths thereof below the means to supply heat to a stand pipe and above the means to extract heat from the stand pipes, whereby heat may be pumped from the elevated location to the lower location with the use of a fluid and the fluid will be in approximate thermal equilibrium between the heat input and heat extraction means thereby enabling the heat to be so transferred over substantial heights.

2. Apparatus as set forth in claim 1 wherein the stand pipes are concentric over a substantial portion of their length and an expansion chamber is attached to the upper terminus of the outer stand pipe.

3. Apparatus as set forth in claim 2 wherein heat is supplied to the outer of the concentric stand pipes through the heat input means, and the inner of the concentric stand pipes includes a flared upper portion positioned below the expansion chamber and extending towards and being adjacent to but not in contact with the wall of the outer stand pipe to collect liquid expelled upward when heat is supplied to the outer stand pipe.

4. Apparatus as set forth in claim 2 wherein the outer stand pipe is concentric with the inner stand pipe above and below the means through which heat is supplied but bypasses the inner stand pipe at such means, and the inner stand pipe extends into the expansion chamber attached to the outer stand pipe.

5. Apparatus for transferring heat from an elevated location to a lower location, comprising: first and second concentric stand pipes, the first stand pipe being disposed concentrically within the second stand pipe and being in thermalconductive relationship so as to provide substantial thermal equilibrium between the fluids in the stand pipes, the bottom portion of the second stand pipe being closed and spaced from the open bottom portion of the first stand pipe to permit flow therebetween, the upper terminus of the first stand pipe being enlarged in a flared manner extending adjacent to but spaced from the wall of the second stand pipe, the upper terminus of the second stand pipe being enlarged into a closed expansion chamber above the flared portion of the first stand pipe, means to supply heat to the second stand pipe at an elevated location, and means to extract heat from the second stand pipe at a lower location whereby a fluid may be contained in the stand pipes with the level thereof below the flared portion of the first stand pipe and above the means to supply heat to the second stand pipe and, upon the input of sufficient heat through such means, the fluid will be expelled upward in the second stand pipe, collected by the flared portion of the first stand pipe and, as a result of the thus produced unequal levels in the stand pipes, flow downward in the first stand pipe into the second stand pipe at the bottom portion thereof, thus providing a flow of heat in the fluid at the heat extraction means.

6. A method of transferring heat from an elevated location to a lower location, comprising: adding heat to a fluid contained in a stand pipe, ejecting the fluid upward as a result of the addition of the heat, collecting the fluid in another stand pipe, flowing the liquid through the other stand pipe into the first stand pipe at connected lower portions of the stand pipes, extracting heat from the fluid at a lower location, and flowing heat between the fluids in the stand pipes below the heat input means to provide substantial thermal equilibrium between the fluids at such positions.

* * * * *